US005322289A

United States Patent [19]

Abrams et al.

[11] Patent Number: 5,322,289

[45] Date of Patent: Jun. 21, 1994

[54] PRESSURE-SENSITIVE GRIP MEASURING DEVICE

[76] Inventors: Jack Abrams, 6 Pinewood Dr.; Harold Juman, 32 Raybor Rd., both of Commack, N.Y. 11725; Morton Glick, 5 Simon Ct., East Northport, N.Y. 11731

[21] Appl. No.: 11,182

[22] Filed: Jan. 29, 1993

[51] Int. Cl.[5] ..... A63B 69/36

[52] U.S. Cl. ..... 273/187.5; 273/193 R; 128/782

[58] Field of Search ..... 273/187.5, 75, 73 J, 273/29 R, 26 R, 26 B, 186.2, 186.3, 187.4; 128/782

[56] References Cited

U.S. PATENT DOCUMENTS

| | | | |
|---|---|---|---|
| 3,323,367 | 6/1967 | Searle | 273/187.5 |
| 3,762,720 | 10/1973 | Jett | 273/187.5 |
| 3,897,058 | 7/1975 | Koch | 273/187.5 X |
| 4,027,879 | 6/1977 | Wright | 273/187.5 X |
| 4,103,896 | 8/1978 | Lorang | 273/187.5 |
| 4,138,118 | 2/1979 | Budney | 273/187.5 |
| 4,660,832 | 4/1987 | Shomo | 273/73 J |
| 4,861,034 | 8/1989 | Lee | 273/187.5 |
| 4,930,785 | 6/1990 | Mills | 273/194 R X |
| 5,226,650 | 7/1993 | Suttner | 273/73 J |

*Primary Examiner*—George J. Marlo
*Attorney, Agent, or Firm*—Klauber & Jackson

[57] ABSTRACT

A pressure-sensitive grip measuring device 10 includes a handle 12 comprised of an electrically conductive splined core 22, a non-electrically conductive deformable material 28 disposed annularly around the splined core 22, a electrically conductive material 34 disposed annularly around the deformable material 28, and a protective material 36 disposed annularly around the electrically conductive material 34 and the entire handle in general. The device 10 also includes an electrically conductive shaft 14 connected to the splined core 22, and a case 16 housing a battery 18 and a user detectable indicator 20. An electrical circuit is formed in the device 10 such that a normally open switch is formed between the electrically conductive material 34 and the splined core 22. When excessive pressure is applied by a user to the handle 12 the switch is closed and the indicator 20 becomes active. Thus, the user is alerted when such excessive pressure is applied.

53 Claims, 5 Drawing Sheets

FIGURE 4
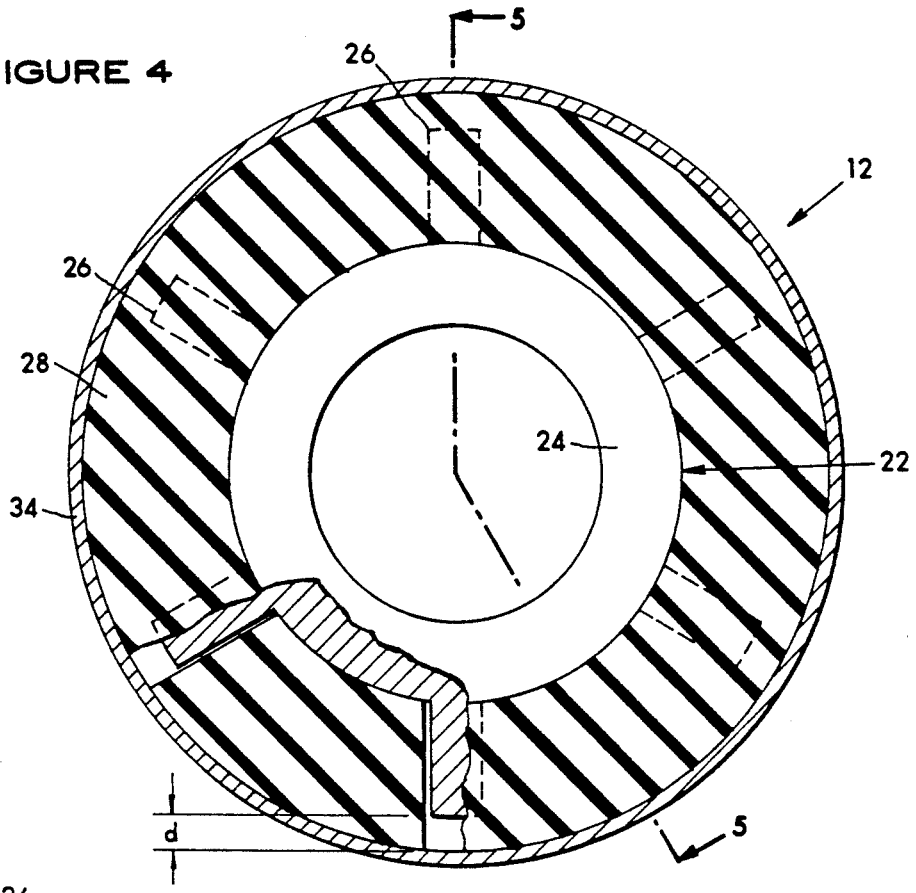
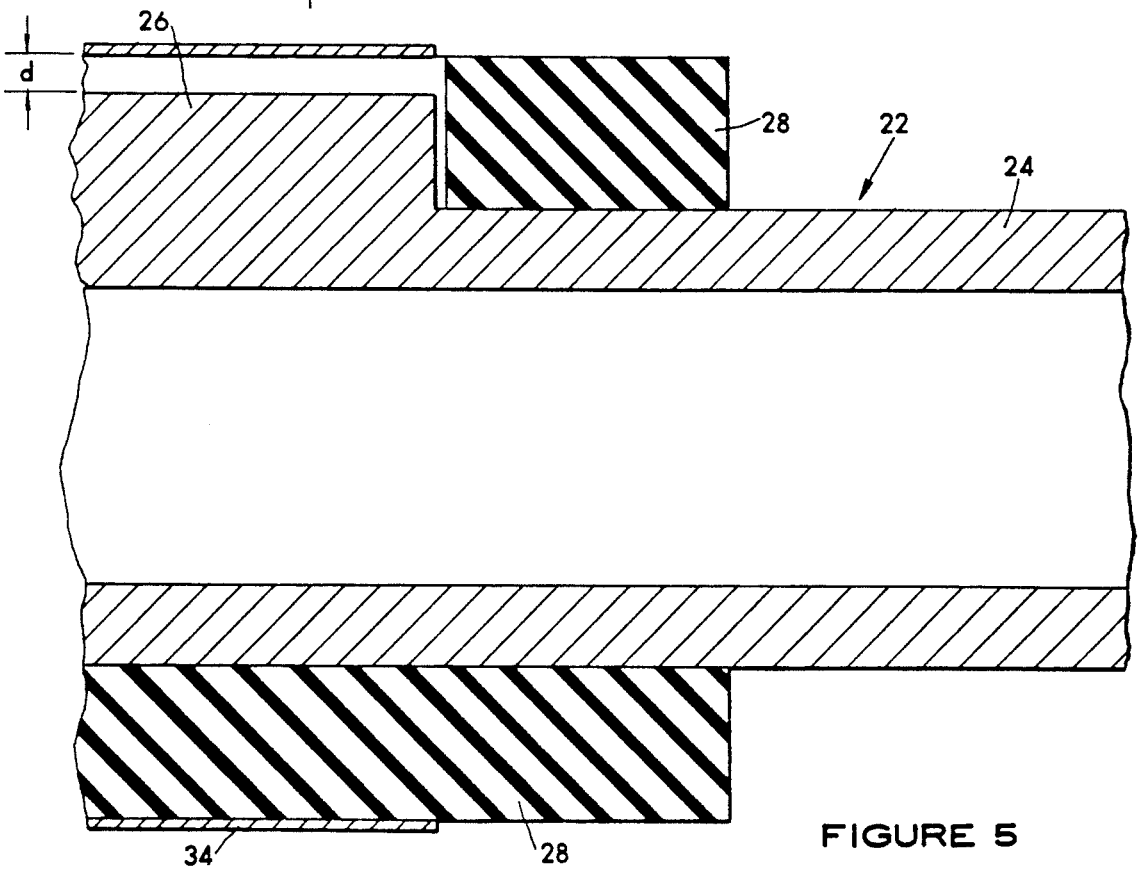
FIGURE 5

PRESSURE-SENSITIVE GRIP MEASURING DEVICE

BACKGROUND OF THE INVENTION

1. Field of the Invention

The present invention relates to hand grip instructional aids and, more particularly, to a device that indicates when a user is applying excessive pressure to a hand grip of a golf club, a tennis racket, or any number of other hand manipulated implements.

2. Description of the Prior Art

There are various sports which require an athlete to utilize a club or some other hand manipulated implement for swinging at a ball which is fixed at a stationary position in front of the athlete or else is rapidly advancing toward the athlete. An example of such a sport is golf, wherein the golfer utilizes a golf club to drive a stationary golf ball that is positioned either on a golf tee or on the ground in front of him. In other sports, such as tennis or baseball, the athlete utilizes a tennis racket or a baseball bat, respectively, for swinging at a rapidly approaching ball. In all of the above mentioned sports, and numerous others, it has been found that the athlete's grip on the associated athletic club plays an important role in the final direction and control of the ball.

To assist an athlete in developing a proper grip on an athletic club or other hand manipulated implement, several inventive efforts have been made. For example, U.S. Pat. Nos. 4,930,785, 4,103,896, 4,138,118, 3,897,058, 4,861,034 and 4,027,879, all address various methods of assisting an athlete in developing a proper grip. A brief description of these prior art devices is now given.

U.S. Pat. No. 4,930,785 (Mills) discloses a golf grip handle incorporating a battery operated electrical circuit that is activated in response to excessive grip pressure at a particular point along the handle. The electrical circuit is connected to a motor that produces vibrations in the handle so as to alert the user of the excessive grip pressure.

U.S. Pat. No. 4,103,896 (Lorang) discloses a golf club handle which includes a switch to be placed under the middle fingers of one of the user's hands to provide an output signal if excessive pressure is applied by those fingers. Typically, the switch is placed under the middle finger of the user's right hand to sense excessive pressure and to provide an output signal as a result of the excessive pressure.

U.S. Pat. No. 4,138,118 (Budney) discloses a strain gauge on a handle of a golf club to sense an applied pressure of a user's fingers on the handle. A plurality of strain gauges may be placed axially on the handle so that the pressure of the fingers at several locations on the handle may be sensed. The strain gauge(s) are connected to a pen recorder to record the output of the gauge(s) continuously during the user's golf swing. The apparatus requires a cord extending from the handle to the pen recorder which may be distracting to the user.

U.S. Pat. No. 3,897,058 (Koch) discloses a training aid apparatus for achieving a correct grip on a golf club, tennis racket, baseball bat, etc., that requires a pressure responsive grip. The apparatus includes a hollow handle connected to a pressure gauge so that the force of the user's hands can be sensed. The sensed pressure is remote from the user, and accordingly there is no sensation or output indication to the used while he or she is swinging. An instructor apparently observes the output pressure. Since the sensing is remote, the handle being gripped is connected to the pressure gauge by a cord, which may be distracting to the user.

U.S. Pat. No. 4,861,034 (Lee) discloses a golf grip training device that may be installed on a conventional golf club. The device includes an elongated pressure sensitive switch that is mounted to the underside of the golf club handle and that is responsive to a user's grip pressure. The switch is connected to a signalling device that is further mounted to the golf club which emits an audible signal when a predetermined grip pressure is exceeded.

U.S. Pat. No. 4,027,879 (Wright) discloses a tennis racket grip training device which operates upon a form of translation of pressure, whereby an excessive application of pressure to the tennis racket handle causes a partial disengagement of the handle from its connecting shaft, thereby producing both a visible and an audible indication of an improper hand grip.

Although all of the above-mentioned prior art devices provide various methods of assisting an athlete in developing a proper grip, none propose a device having a specific handle construction comprised of a conductive splined core, a deformable material disposed annularly around the splined core, and a conductive material disposed in a further annular relation around the deformable material so as to allow any portion of a user's grip on the handle to be sensed for excessive applied pressure by way of an electrical contact being made between the conductive splined core and the conductive material and to provide a user detectable indication thereof. Such a device would be desirable for training in the sports of golf, tennis, baseball, and numerous others where an athlete's grip plays an important role in his or her performance. It is therefore desirable to provide such a device and to overcome the shortcomings of the above-mentioned prior art devices in this area.

SUMMARY OF THE INVENTION

The present invention contemplates a pressure-sensitive grip measuring device that can be used to train or assist athletes in developing a proper hand grip. The device provides a handle construction that is comprised primarily of a conductive splined core, a deformable material disposed annularly around the splined core, and a conductive material disposed in a further annular relation around the deformable material. The outer conductive material is typically covered by a protective material; for example a rubber golf club grip in the case of a golf club grip measuring device.

Connected to the conductive splined core is a shaft which, in combination with the handle, has a weight that is appropriate to simulate that of the actual club or hand implement for which the athlete user will be trained. Within the shaft, or attached thereto, a battery and a user detectable indicator are present, thereby forming a first of two parts of an electrical circuit. The second part of the electrical circuit is comprised of a switch which is formed between the conductive splined core and the annularly disposed conductive material. The switch is closed when the conductive splined core comes into contact with the annularly disposed conductive material, which results in the user detectable indicator becoming active.

Of course, the conductive splined core and the annularly disposed conductive material are usually separated from each other by the annularly disposed deformable material. Thus, the annularly disposed deformable material must be chosen with certain resilient characteristics in mind such that when excessive pressure is applied to the outer protective material the annularly disposed conductive material is allowed to come into contact with the conductive splined core, and when such excessive pressure is removed the annularly disposed conductive material and the conductive splined core are again separated from each other by the thickness of the annularly disposed deformable material.

From the above descriptive summary, it is thus apparent how the specific construction of the present invention pressure-sensitive grip measuring device overcomes the shortcomings of the above-mentioned prior art devices.

Accordingly, the primary objective of the present invention is to provide a pressure-sensitive grip measuring device that can be used to train or assist athletes in developing a proper hand grip.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention pressure-sensitive grip measuring device, reference is now made to the appended drawings. These drawings should not be construed as limiting the present invention, but are intended to be exemplary only.

FIG. 4 is a cross-sectional view of the present invention pressure-sensitive grip measuring device of FIG. 1 taken along line 4A—4A of FIG. 1, with a cutaway portion having a cross-sectional view taken along line 4B—4B of FIG. 1, It should be noted that the outer protective material shown in FIG. 1 is removed in this view.

FIG. 5 is a cross-sectional view of the present invention pressure-sensitive grip measuring device of FIG. 1 taken along line 5—5 of FIG. 4

PREFERRED EMBODIMENTS OF THE PRESENT INVENTION

Figure 1:
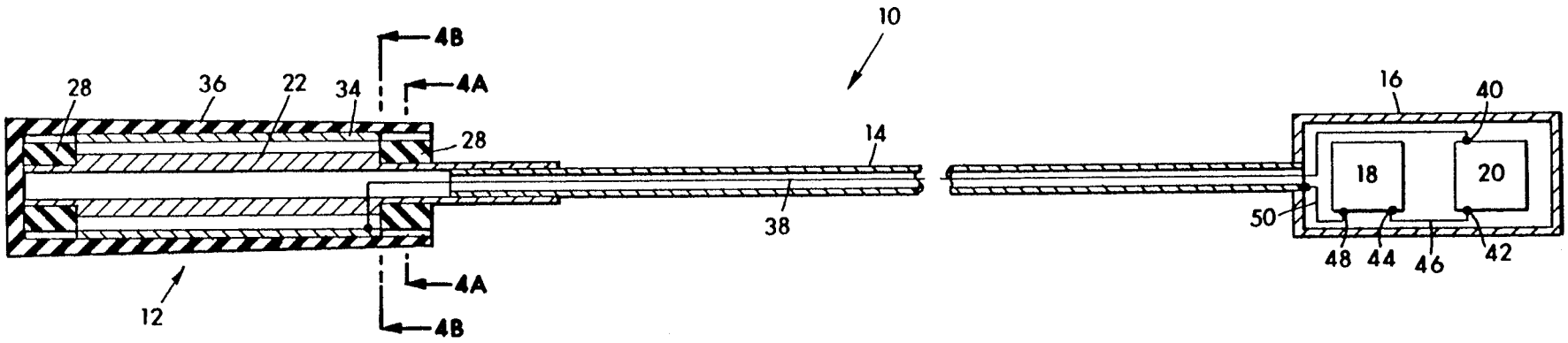
FIG. 1 is a side cross-sectional view of a pressure-sensitive grip measuring device according to the present invention, This particular device is in the form of a golf club handle with a corresponding golf club shaft and a case.

Referring to FIG. 1, there is shown a present invention pressure-sensitive grip measuring device 10 in the form of a golf club handle 12 with a corresponding golf club shaft 14. The golf club shaft 14 connects the golf club handle 12 with a case 16 which holds a battery 18 and a user detectable indicating device 20. The indicating device 20 may be in the form of a buzzer or a light, or a similar type of active detectable indicating device. The golf club handle 12, the golf club shaft 14, and the case 16 are weighted so as to simulate the weight of an actual golf club. It should be noted that the length of the shaft 14 should be shorter than an actual golf club shaft so as to discourage the actual hitting of golf balls which could damage the case 16.

The golf club handle 12 is first comprised of a splined core 22 that is connected to the golf club shaft 14. The splined core 22 may be made of an electrically conductive rigid metal material such as copper or steel. The golf club shaft 14 may also be made of an electrically conductive metal material such as aluminum or steel. Thus, when the splined core 22 and the golf club shaft 14 are connected, a electrical contact is formed between them.

Figure 2:
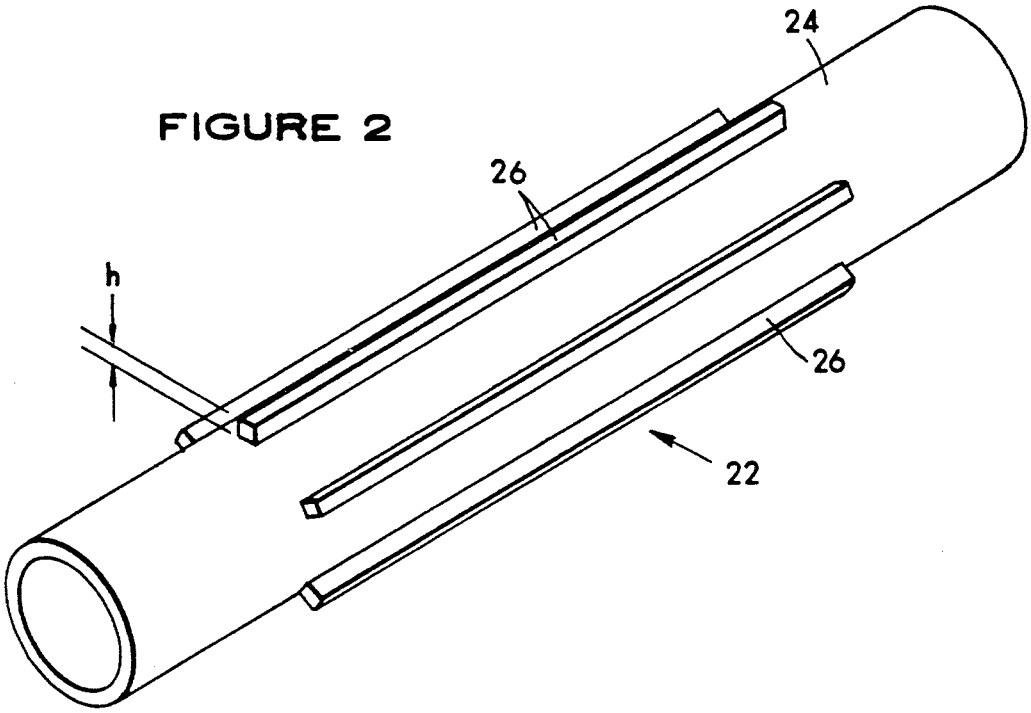
FIG. 2 is a three-dimensional view of a conductive splined core that is used in the present invention pressure-sensitive grip measuring device shown in FIG. 1.

Referring to FIG. 2, a three-dimensional view of the splined core 22 is shown. The splined core 22 is essentially comprised of a tubular body 24 and a plurality of spline elements 26 formed around the outer circumference of the tubular body 24. The height of each spline element 26 is shown with a dimension, h.

Referring back to FIG. 1, the golf club handle 12 is also comprised of a deformable material 28 that is annularly disposed around the splined core 22. The deformable material 28 may be made of a non-electrically conductive, resilient material such as rubber. Thus, there is no electrical contact between the splined core 22 and the deformable material.

Figure 3:
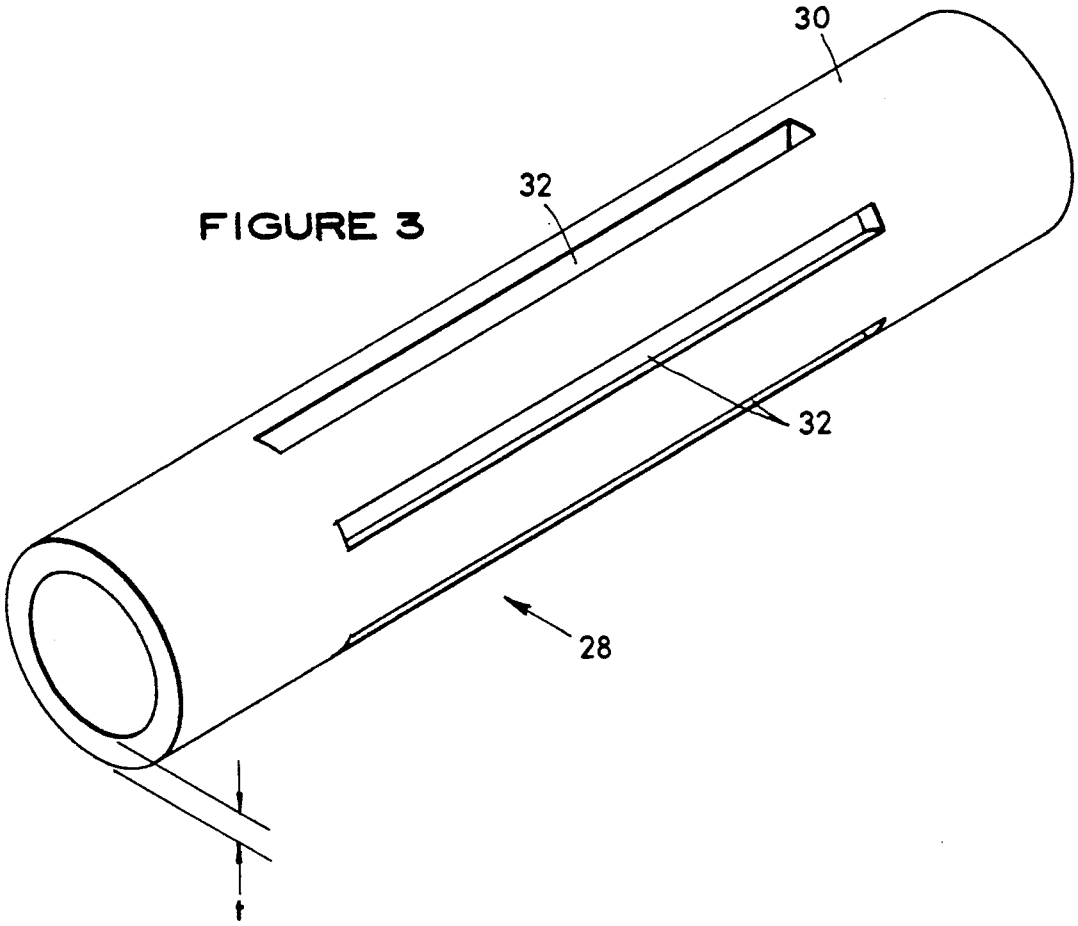
FIG. 3 is a three-dimensional view of a deformable material that is used in the present invention pressure-sensitive grip measuring device shown in FIG. 1.

Referring to FIG. 3, a three-dimensional view of the deformable material 28 is shown. The deformable material 28 is essentially comprised of a tubular body 30 having a plurality of openings 32. Each opening 32 in the tubular body 30 corresponds to a spline element 26 of the splined core 22. Thus, the structure of the tubular body 30 of the deformable material 28 is such that it only covers the tubular body 24 of the splined core 22 and not the spline elements 26. It should be noted that the inner diameter of the tubular body 30 of the deformable material 28 is approximately the same as the outer diameter of the tubular body 24 of the splined core 22 so as to ensure a snug fit between the two. The thickness of the tubular body 30 is shown with a dimension, t.

Referring back to FIG. 1, the golf club handle 12 is also comprised of an electrically conductive material 34 that is annularly disposed around the deformable material 28. The electrically conductive material 34 may be made of a thin, somewhat deformable, metal material such as copper. The electrically conductive material 34 is normally separated from the tubular body 24 of the splined core 22 by the deformable material 28, or by the dimension, t. However, the electrically conductive material 34 is normally separated from the spline elements 26 of the splined core 22 by a dimension, d. The dimension, d, is obtained according to the following formula, $$t-h=d.$$

It should be noted that a protective material 36 is disposed around the electrically conductive material 34, or around the entire handle 12 in general. This protective material 36 is essentially a typical golf grip and may be made of rubber or leather, or any similar non-electrically conductive golf grip material.

Referring to FIG. 4, there is shown a cross-sectional view of the golf club handle 12 with the outer protective material 36 removed. From this view the tubular body 24 of the splined core 22 is shown with six spline elements 26 extruding therefrom. Also shown is the deformable material 28 separating the splined core 22 from the electrically conductive material 34. A cutaway portion reveals how the splined elements 26 are normally separated from the electrically conductive material 34 by the dimension, d.

Referring to FIG. 5, there is shown an angled cross-sectional view of the golf club handle 12, again with the outer protective material 36 removed. This view also reveals how the splined elements 26 are normally separated from the electrically conductive material 34 by the dimension, d.

Referring back to FIG. 1, the electrically conductive material 34 is electrically connected to a first terminal 40 of the indicating device 20 by way of a first wire 38. A second terminal 42 of the indicating device 20 is electrically connected to a first terminal 44 of the battery 18 by way of a second wire 46. Finally, a second terminal 48 of the battery 18 is electrically connected to the golf club shaft 14 by way of a third wire 50. As previously mentioned, the golf club shaft 14 is electrically connected to the splined core 22. Since the spline elements 26 of the splined core 22 are normally separated from the electrically conductive material 34 by the dimension, d, a normally open switch in an electrical circuit is thus formed. This switch may be closed when external pressure is applied to the protective material 36, and hence to the electrically conductive material 34 and the deformable material 28, such that the electrically conductive material 34 comes into contact with the spline elements 26 of the splined core 22. When such an event occurs, the electrical circuit is closed and the indicating device 20 becomes active. It should be noted that the circuit positions of the battery 18 and the indicating device 20 are interchangeable. It should further be noted that the first 38, second 46, and third 50 wires may be typical copper wires.

To use the above-described electromechanical apparatus as a pressure-sensitive grip measuring device, the thickness and composition of the deformable material 28 is chosen such that a deflection equal to the dimension, d, occurs when a specific external pressure is applied thereto. This specific external pressure corresponds to an improper, or more appropriately an excessive, amount of external pressure being applied to an actual golf club handle. Thus, when a user applies this excessive external pressure to the golf club handle 12, electrical contact is made between the electrically conductive material 34 and the splined core 22 and the indicating device 20 becomes active, thereby alerting the user accordingly. Conversely, when a user applies less than the above-described specific external pressure, the indicating device 20 remains in its normally inactive state and the user thereby knows that excessive pressure is not being applied.

Figure 6:
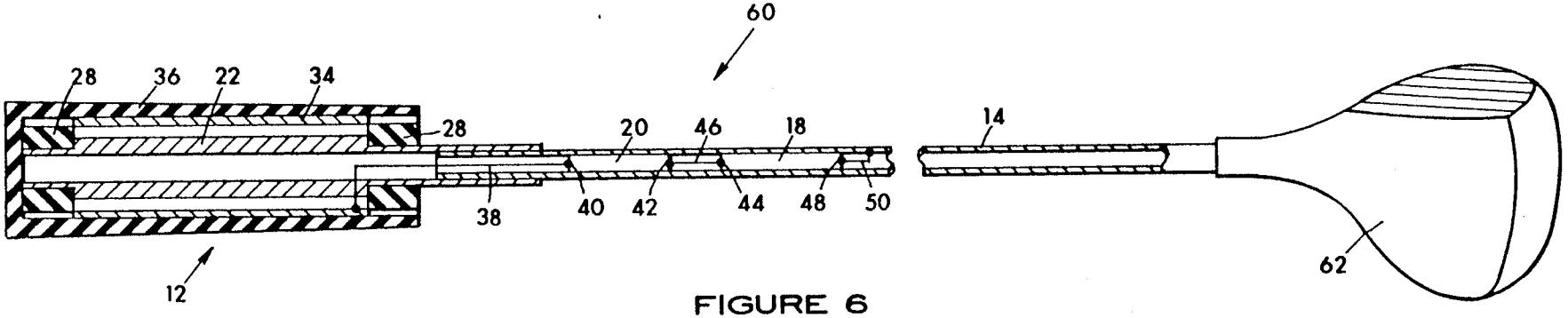
FIG. 6 is a side cross-sectional view of a pressure-sensitive grip measuring device according to the present invention, This particular device is in the form of a golf club shaft connecting a golf club handle to a typical golf club head.

Referring to FIG. 6, there is shown a present invention pressure-sensitive grip measuring device 60 having an alternate embodiment to that of the device 10 shown in FIG. 1. In this alternate embodiment device 60 the battery 18 and the indicator 20 are secured in the golf club shaft 14 so that a typical golf club head 62 may be attached to the end of the shaft 14. Furthermore, the shaft 14 may have the length of a typical golf club shaft, thereby allowing the user to develop a proper grip by using the present invention device 60 in a more realistic manner.

Figure 7:
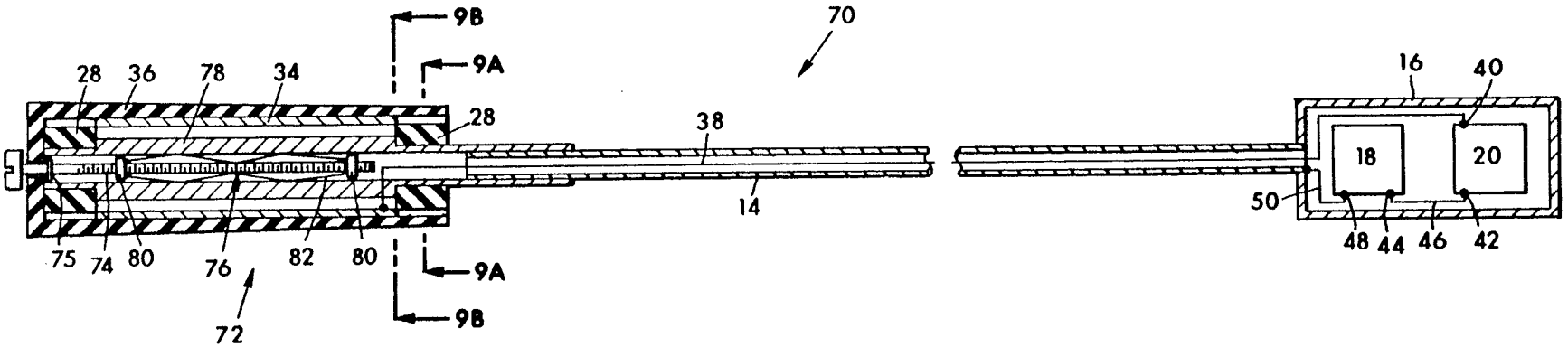
FIG. 7 is a side cross-sectional view of an adjustable pressure-sensitive grip measuring device according to the present invention, This particular device is in the form of a golf club handle with a corresponding golf club shaft and a case.

Referring to FIG. 7, there is shown a present invention pressure-sensitive grip measuring device 70 having a further alternate embodiment to that of the devices 10,60 shown in FIGS. 1 and 6, respectively. In this alternate embodiment device 70 a golf club handle 72 is provided, the pressure sensitivity of which is adjustable. The pressure sensitivity is adjustable by way of a threaded screw 74, an expandable and contractible adjustment means 76, and a plurality of annularly disposed arced sections 78. The threaded screw 74 has a lip 75 extruding therefrom so as to maintain the screw 74 in a rotatably secure position. The expandable and contractible adjustment means 76 is comprised of two oppositely threaded annular end sections 80 annularly disposed around and mating with the threaded screw 74 and a deformable material 82 connected between both annular end sections 80 and annularly disposed about the threaded screw 74. Since the two end sections 80 are oppositely threaded, the direction of rotation in which the screw 74 is turned determines whether the end sections 80 become closer to or further from each other. When the end sections 80 become closer to each other the deformable material 82 expands radially outward against the plurality of annularly disposed arced sections 78. When the end sections 80 become further from each other the deformable material 82 contracts radially inward from the plurality of annularly disposed arced sections 78. It should be noted that both the annular end sections 80 and the deformable material 82 may be made from a variety of materials including metal and plastic. It should also be noted that the plurality of annularly disposed arc sections 78 may be made of an electrically conductive rigid material such as copper or steel and that each of the plurality of annularly disposed arc sections 78 is connected to the golf club shaft 14 such that electrical contact is formed between them. It should further be noted that the remaining components shown in FIG. 7 are essentially identical to those shown in FIG. 1 and therefore are numerically identified as such.

Figure 8:
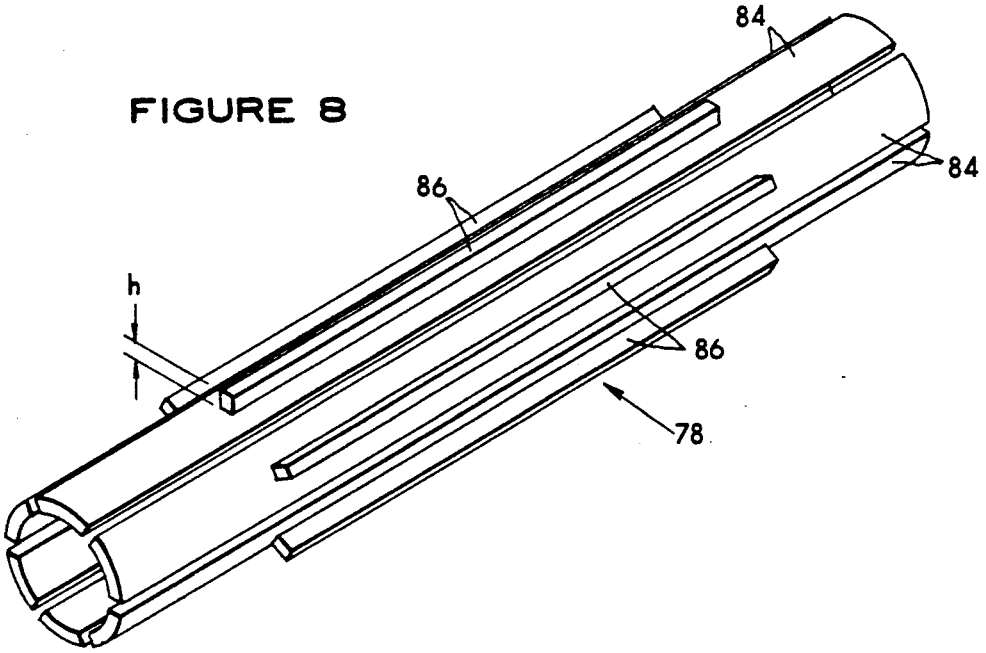
FIG. 8 is a three dimensional view of a plurality of arced sections, each having a spline element formed along the outer circumference of each arced section, that are used in the present invention adjustable pressure-sensitive grip measuring device shown in FIG. 7.

Referring to FIG. 8, a three dimensional view of the plurality of arced sections 78 is shown. The plurality of arced sections 78 is essentially comprised of six arced sections 84 each having a spline element 86 formed along the outer circumference of each arced section 84. The height of each spline element 86 is shown with a dimension, h, similar to the spline elements 26 shown in FIG. 2. It should be noted that the number of arced sections 84 may vary according to such factors as the size of the handle 72 and the sensitivity requirements of the device 70, as will be explained shortly.

Figure 9:
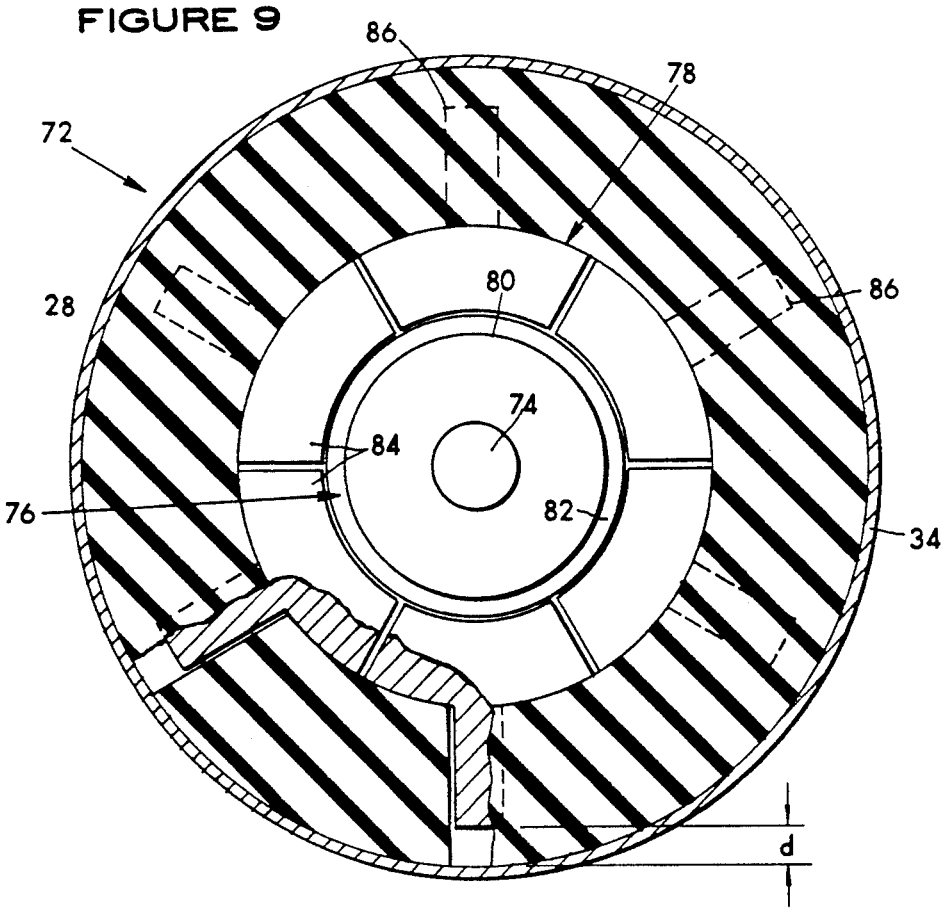
FIG. 9 is a cross-sectional view of the present invention adjustable pressure-sensitive grip measuring device of FIG. 7 taken along line 9A—9A of FIG. 7, with a cutaway portion having a cross-sectional view taken along line 9B—9B of FIG. 7. It should be noted that the outer protective material shown in FIG. 7 is removed in this view.

Referring to FIG. 9, there is shown a cross-sectional view of the golf club handle 72 with the outer protective material 36 removed. From this view the expandable and contractible adjustment means 76 is shown with the threaded screw 74, a threaded end section 80, and the deformable material 82. Also shown is the plurality of arced sections 78 with the six arced sections 84 and the six corresponding spline elements 86 extruding therefrom. Similar to the device shown in FIG. 4, the deformable material 28 is shown separating the splined elements 86 of the arced sections 84 from the electrically conductive material 34. A cutaway portion reveals how the splined elements 86 are normally separated from the electrically conductive material 34 by the dimension, d.

Referring simultaneously to FIGS. 7 and 9, the pressure sensitivity of the golf club handle 72 is adjusted by turning the threaded screw 74 in a direction that results in the deformable material 82 either expanding or contracting in a radial manner. When the deformable material 82 expands radially outward against the plurality of arced sections 78, the distance between the spline elements 86 and the electrically conductive material 34, represented by the dimension, d, decreases. As this distance decreases, the amount of external pressure that is required to be applied to the golf club handle 72 such that electrical contact is made between the electrically conductive material 34 and at least one of the plurality of arced sections 78 also decreases. Thus, when the distance between the spline elements 86 and the electrically conductive material 34 .is decreased, the amount of external pressure that is required to activate the indicating device 20 is also decreased, thereby increasing the sensitivity of the golf club handle 72. Conversely, when the deformable material 82 contracts radially inward from the plurality of arced sections 78, the distance between the spline elements 86 and the electrically conductive material 34 increases. As this distance increases, the amount of external pressure that is required to be applied to the golf club handle 72 such that electrical contact is made between the electrically conductive material 34 and at least one of the plurality of arced sections 78 also increases. Thus, when the distance between the spline elements 86 and the electrically conductive material 34 is increased, the amount of external pressure that is required to activate the indicating device 20 is also increased, thereby decreasing the sensitivity of the golf club handle 72.

At this point it should be noted that the present invention adjustable pressure-sensitive grip measuring device 70 shown in FIG. 7 can also have the battery 18 and the indicator 20 secured in the golf club shaft 14 in a manner similar to that of the device 60 shown in FIG. 6. Thus, a typical golf club head may be attached to the end of the shaft 14 instead of the case 16, thereby allowing a user to develop a proper grip by using the present invention device 70 in a more realistic manner.

The relatively simple nature of the above-described present invention, although described herein in the form of golf grip measuring devices 10,60,70, allows for easy adaption to other applications, such as tennis racket and baseball bat grip measuring devices. Accordingly, with the present invention pressure-sensitive grip measuring devices 10,60,70 now fully described it can thus be seen that the primary objective set forth above is efficiently attained and, since certain changes may be made in the above described devices 10,60,70 without departing from the scope of the invention, it is intended that all matter contained in the above description or shown in the accompanying drawings shall be interpreted as illustrative and not in a limiting sense.

What is claimed is:

1. A pressure-sensitive grip measuring device for training or otherwise assisting users in perfecting a proper hand grip, said pressure-sensitive grip measuring device comprising:

handle means resembling a handle portion of a hand manipulated implement, said handle means having an electrically conductive splined core with a tubular body and a plurality of outwardly extruding spline elements, a non-electrically conductive deformable material annularly disposed around said tubular body of said splined core, and an electrically conductive material annularly disposed around said deformable material and separated from said spline elements by a predetermined distance;

electrical indicator means becoming active when a user has applied an excessive amount of external pressure to said handle means, said excessive amount of external pressure attained when said deformable material allows said electrically conductive material to be deflected said predetermined distance so as to be in contact with any of said plurality of spline elements;

battery means for supplying an electrical current to activate said electrical indicator means; and circuit means for electrically connecting together said battery means, said electrical indicator means, said electrically conductive material, and said electrically conductive splined core, in a manner such that an electrical circuit with a normally open switch between said electrically conductive material and said plurality of spline elements is formed, wherein said normally open switch is closed when said user has applied said excessive amount of external pressure to said handle means, thereby activating said electrical indicator means and alerting said user accordingly.

2. The pressure-sensitive grip measuring device as defined in claim 1, further comprising:

a case for housing said electrical indicator means and said battery means; and a shaft for connecting said handle means to said case.

3. The pressure-sensitive grip measuring device as defined in claim 2, wherein said handle means, said case, and said shaft are weighted so as to simulate an actual weight of said hand manipulated implement.

4. The pressure-sensitive grip measuring device as defined in claim 3, wherein said handle means further comprises a protective material annularly disposed around said electrically conductive material.

5. The pressure-sensitive grip measuring device as defined in claim 4, wherein said electrically conductive splined core maintains six outwardly extruding spline elements.

6. The pressure-sensitive grip measuring device as defined in claim 5, wherein said electrically conductive splined core is made of an electrically conductive rigid metal material.

7. The pressure-sensitive grip measuring device as defined in claim 4, wherein said non-electrically conductive deformable material is made of a resilient material such as rubber.

8. The pressure-sensitive grip measuring device as defined in claim 4, wherein said electrically conductive material is made of a thin, somewhat deformable, metal material.

9. The pressure-sensitive grip measuring device as defined in claim 4, wherein said electrical indicator means is an electrical buzzer.

10. The pressure-sensitive grip measuring device as defined in claim 4, wherein said electrical indicator means is an electrical light.

11. The pressure-sensitive grip measuring device as defined in claim 4, wherein said shaft is made of an electrically conductive rigid metal material, and wherein said shaft is connected to said splined core such that electrical contact is made therebetween.

12. The pressure-sensitive grip measuring device as defined in claim 11, wherein said circuit means for electrically connecting together said battery means, said electrical indicator means, said electrically conductive material, and said electrically conductive splined core is a plurality of wires.

13. The pressure-sensitive grip measuring device as defined in claim 12, wherein said plurality of wires are typical copper wires.

14. The pressure-sensitive grip measuring device as defined in claim 1, further comprising:

a head of said hand manipulated implement; and a shaft for connecting said handle means to said head of said hand manipulated implement, and for housing said electrical indicator means and said battery means therein.

15. The pressure-sensitive grip measuring device as defined in claim 14, wherein said handle means, said head of said hand manipulated implement, and said shaft are weighted so as to simulate an actual weight of said hand manipulated implement.

16. The pressure-sensitive grip measuring device as defined in claim 15, wherein said handle means further comprises a protective material annularly disposed around said electrically conductive material.

17. The pressure-sensitive grip measuring device as defined in claim 16, wherein said electrically conductive splined core maintains six outwardly extruding spline elements.

18. The pressure-sensitive grip measuring device as defined in claim 17, wherein said electrically conductive splined core is made of an electrically conductive rigid metal material.

19. The pressure-sensitive grip measuring device as defined in claim 16, wherein said non-electrically conductive deformable material is made of a resilient material such as rubber.

20. The pressure-sensitive grip measuring device as defined in claim 16, wherein said electrically conductive material is made of a thin, somewhat deformable, metal material.

21. The pressure-sensitive grip measuring device as defined in claim 16, wherein said electrical indicator means is an electrical buzzer.

22. The pressure-sensitive grip measuring device as defined in claim 16, wherein said electrical indicator means is an electrical light.

23. The pressure-sensitive grip measuring device as defined in claim 16, wherein said shaft is made of an electrically conductive rigid metal material, and wherein said shaft is connected to said splined core such that electrical contact is made therebetween.

24. The pressure-sensitive grip measuring device as defined in claim 23, wherein said circuit means for electrically connecting together said battery means, said electrical indicator means, said electrically conductive material, and said electrically conductive splined core is a plurality of wires.

25. The pressure-sensitive grip measuring device as defined in claim 24, wherein said plurality of wires are copper wires.

26. An adjustable pressure-sensitive grip measuring device for training or otherwise assisting users in perfecting a proper hand grip, said adjustable pressure-sensitive grip measuring device comprising:

handle means resembling a handle portion of a hand manipulated implement, said handle means having a plurality of electrically conductive arced sections arranged in an annular manner with each of said plurality of arced sections having an outwardly extruding spline element, a non-electrically conductive deformable material annularly disposed around said annularly arranged arced sections excluding said plurality of spline elements, and an electrically conductive material annularly disposed around said deformable material and separated from said spline elements by a critical distance;

adjustment means disposed within said annularly arranged arced sections for expanding and contracting said annular arrangement so as to adjust said critical distance;

electrical indicator means becoming active when a user has applied an excessive amount of external pressure to said handle means, said excessive amount of external pressure attained when said deformable material allows said electrically conductive material to be deflected said critical distance so as to be in contact with any of said plurality of spline elements;

battery means for supplying an electrical current to activate said electrical indicator means; and circuit means for electrically connecting together said battery means, said electrical indicator means, said electrically conductive material, and said plurality of electrically conductive arced sections, in a manner such that an electrical circuit with a plurality of normally open switches between said electrically conductive material and each of said plurality of spline elements is formed, wherein said normally open switches are closed when said user has applied said excessive amount of external pressure to said handle means, thereby activating said electrical indicator means and alerting said user accordingly.

27. The adjustable pressure-sensitive grip measuring device as defined in claim 26, further comprising:

a case for housing said electrical indicator means and said battery means; and a shaft for connecting said handle means to said case.

28. The adjustable pressure-sensitive grip measuring device as defined in claim 27, wherein said handle means, said case, and said shaft are weighted so as to simulate an actual weight of said hand manipulated implement.

29. The adjustable pressure-sensitive grip measuring device as defined in claim 28, wherein said handle means further comprises a protective material annularly disposed around said electrically conductive material.

30. The adjustable pressure-sensitive grip measuring device as defined in claim 29, wherein said plurality of electrically conductive arced sections is comprised of six electrically conductive arced sections each having an outwardly extruding spline element.

31. The adjustable pressure-sensitive grip measuring device as defined in claim 30, wherein each said electrically conductive arced section is made of an electrically conductive rigid metal material.

32. The adjustable pressure-sensitive grip measuring device as defined in claim 29, wherein said non-electrically conductive deformable material is made of a resilient material such as rubber.

33. The adjustable pressure-sensitive grip measuring device as defined in claim 29, wherein said electrically conductive material is made of a thin, somewhat deformable, metal material.

34. The adjustable pressure-sensitive grip measuring device as defined in claim 29, wherein said electrical indicator means is an electrical buzzer.

35. The adjustable pressure-sensitive grip measuring device as defined in claim 29, wherein said electrical indicator means is an electrical light.

36. The adjustable pressure-sensitive grip measuring device as defined in claim 29, wherein said shaft is made of an electrically conductive rigid metal material, and wherein said shaft is connected to said splined core such that electrical contact is made therebetween.

37. The adjustable pressure-sensitive grip measuring device as defined in claim 36, wherein said circuit means for electrically connecting together said battery means, said electrical indicator means, said electrically conductive material, and said electrically conductive splined core is a plurality of wires.

38. The adjustable pressure-sensitive grip measuring device as defined in claim 37, wherein said plurality of wires are typical copper wires.

39. The pressure-sensitive grip measuring device as defined in claim 26, further comprising:

a head of said hand manipulated implement; and a shaft for connecting said handle means to said head of said hand manipulated implement, and for housing said electrical indicator means and said battery means therein.

40. The pressure-sensitive grip measuring device as defined in claim 39, wherein said handle means, said head of said hand manipulated implement, and said shaft are weighted so as to simulate an actual weight of said hand manipulated implement.

41. The pressure-sensitive grip measuring device as defined in claim 40, wherein said handle means further comprises a protective material annularly disposed around said electrically conductive material.

42. The pressure-sensitive grip measuring device as defined in claim 41, wherein said electrically conductive splined core maintains six outwardly extruding spline elements.

43. The pressure-sensitive grip measuring device as defined in claim 42, wherein said electrically conductive splined core is made of an electrically conductive rigid metal material.

44. The pressure-sensitive grip measuring device as defined in claim 41, wherein said non-electrically conductive deformable material is made of a resilient material such as rubber.

45. The pressure-sensitive grip measuring device as defined in claim 41, wherein said electrically conductive material is made of a thin, somewhat deformable, metal material.

46. The pressure-sensitive grip measuring device as defined in claim 41, wherein said electrical indicator means is an electrical buzzer.

47. The pressure-sensitive grip measuring device as defined in claim 41, wherein said electrical indicator means is an electrical light.

48. The pressure-sensitive grip measuring device as defined in claim 41, wherein said shaft is made of an electrically conductive rigid metal material, and wherein said shaft is connected to said splined core such that electrical contact is made therebetween.

49. The pressure-sensitive grip measuring device as defined in claim 48, wherein said circuit means for electrically connecting together said battery means, said electrical indicator means, said electrically conductive material, and said electrically conductive splined core is a plurality of wires.

50. The pressure-sensitive grip measuring device as defined in claim 49, wherein said plurality of wires are copper wires.

51. The adjustable pressure-sensitive grip measuring device as defined in claim 26, wherein said adjustment means is comprised of:

a threaded screw; and an expandable and contractible adjustment means that is annularly disposed around said threaded screw.

52. The adjustable pressure-sensitive grip measuring device as defined in claim 51, wherein said expandable and contractible adjustment means is comprised of:

two oppositely threaded annular end sections annularly disposed around and mating with said threaded screw; and a deformable material connected between said annular end sections and annularly disposed about said threaded screw, such that the direction of rotation of said screw determines the distance between said annular end sections which in turn determines a radial expansion or contraction of said deformable material, thereby expanding or contracting said annular arrangement so as to adjust said critical distance.

53. The adjustable pressure-sensitive grip measuring device as defined in claim 52, wherein said annular end sections and said deformable material are made of either metal or plastic.

* * * * *